US006520268B1

(12) United States Patent
Fairbrother

(10) Patent No.: US 6,520,268 B1
(45) Date of Patent: Feb. 18, 2003

(54) POST DRIVER BEAMS

(76) Inventor: James Ernest Fairbrother, 229 Manuka Road, Glenfield Auckland (NZ)

( * ) Notice: Subject to any disclaimer, the term of this patent is extended or adjusted under 35 U.S.C. 154(b) by 7 days.

(21) Appl. No.: 09/704,823

(22) Filed: Nov. 3, 2000

(51) Int. Cl.[7] ..... B25D 17/28
(52) U.S. Cl. ..... 173/89; 173/88; 173/162.1
(58) Field of Search ..... 52/729.1; 173/88, 173/89, 152, 147, 162.1

(56) References Cited

U.S. PATENT DOCUMENTS 1,320,072 A * 10/1919 Long ..... 425/DIG. 111
3,126,709 A * 3/1964 Dougherty ..... 431/9
4,544,176 A * 10/1985 Helmick ..... 173/42
5,282,511 A * 2/1994 Burenga et al. ..... 173/184

FOREIGN PATENT DOCUMENTS

NZ 174807 7/1974

* cited by examiner

*Primary Examiner*—Scott A. Smith
*Assistant Examiner*—Nathaniel Chukwurah
(74) *Attorney, Agent, or Firm*—Jacobson Holman PLLC

(57) ABSTRACT

Readily available steel "I" beams being strengthened sufficiently (without introducing localised stresses that exacerbate the fatigue difficulty) over at risk regions and particularly adjacent the lower regions of the beam that hitherto have given rise to fatigue difficulties. It is therefore to such a strengthened beam for a post driver or any variant thereof machines made using such a beam, their use and to related methods of strengthening such beams of post drivers.

16 Claims, 4 Drawing Sheets

POST DRIVER BEAMS

FIELD OF THE INVENTION

The present invention relates to post driving apparatus or reconfigurable post driving apparatus (i.e. which may have other applications, e.g. as a ground spiker).

BACKGROUND OF THE INVENTION

In my New Zealand Patent Specification No. 174807 (now ceased) there is disclosed an early variant of the KING HITTER™ post driver that is currently manufactured and sold by my company Fairbrother Industries Limited. The full content of the aforementioned New Zealand Patent Specification No. 174807 and of the current brochures of this company in respect of the various KING HITTER™ models is here included by way of reference.

By way of exemplification the drawings (FIGS. 1 through 4) of my aforementioned New Zealand Patent Specification No. 174807 are appended hereto as FIGS. 1 through 4. For a description of that product reference should be made to New Zealand Patent Specification No. 174807, the full content of which is hereby here incorporated by way of reference.

We have determined that the steel utilized for the upright beam or mast (hereafter "beam") that provides the guide for the monkey which is to strike the top of a post can over time be subject to fatigue resulting in ultimate breakage.

SUMMARY OF THE INVENTION

The present invention relates to readily available steel "I" beams being strengthened sufficiently (without introducing localised stresses that exacerbate the fatigue difficulty) over at risk regions and particularly adjacent the lower regions of the beam that hitherto have given rise to fatigue difficulties.

It is therefore to such a strengthened beam for a post driver or any variant thereof machines made using such a beam, their use and to related methods of strengthening such beams of post drivers that the present invention is directed.

In a first aspect the present invention consists in a beam for or of a post driver, being a steel "I" beam of a kind having a web and two flange pairs each separated from the other pair by the web's lateral width, wherein a lower region of the "I" beam has been strengthened by the provision on at least one side of the web of a (lateral) web spanning member (preferably a plate) which is welded at each of its edges parallel to the longitudinal axis of the "I" beam into a flange of said "I" beam.

Preferably said plate or other spanning member is attached by welding only to a flange of said "I" beam of each of said flange pairs.

Preferably said welding is full seam or stitch welding.

Preferably a plate or other such spanning member is provided on each of the opposing sides of said web of the "I" beam (preferably similarly welded).

Preferably said lower region of the "I" beam is at and adjacent the adaption thereof for connection to a mounting of the post driver.

Preferably said adaption is adapted to provide a pivot mounting.

Preferably said adaption is an outstanding stub axle extending in a direction which includes the plane of said web.

More preferably said adaption is a pivot sleeve to act on a pin or axle from a mounting, the bore of such a sleeve preferably extending normal to the plane of said web and preferably without interrupting the "I" beam form itself.

In other less preferred forms such a sleeve can be provided in a different substantially lateral direction with respect to the "I" beam.

Preferably each flange pair or at least one flanged pair is strengthened by a longitudinally (of "I" beam) running reinforcement plate having been affixed thereto on a side or sides thereof remote from such web.

Preferably one such reinforcing plate is wider than the pair of flanges to which it is affixed (preferably by welding, eg; stitch welding) whilst the other is not.

Preferably the arrangement is substantially as hereinafter described.

Preferably the relative extents of the various strengthenings is substantially as hereinafter described with reference to any one or more of the accompanying drawings.

In still a further aspect the present invention consists in a post driver which utilises a beam reinforced to provide a beam in accordance with the present invention.

In yet a further aspect the invention consists in, a post driver, of a kind with a pivotally mounted beam, characterised in that said beam is of a fabricated construction at least essentially of a steel "I" beam of a kind having a web and two flange pairs separated by the web's lateral width, a first longitudinally running strengthening strip welded to the outside of one of said flange pairs, optionally a second longitudinally running strip welded to the outside surface of the other flange pair, and (on at least one side of the web) a spanning member between the flanges of the two pairs to reinforce the zone at which beam is pivot mounted, such a spanning member being welded only into each said flange.

Preferably there is similarly mounted a spanning member (e.g. plate) on each side of the web and each is similarly attached.

Preferably the pivot is in alignment with the web of said "I" beam.

Preferably said post driver is of a kind typified by the aforementioned New Zealand patent specification and/or a post driver of the KING HITTER™ type (optionally with some of the variable characteristics of that range).

BRIEF DESCRIPTION OF THE DRAWINGS

A preferred form of the present invention will now be described with reference to the accompanying drawings in which.

DETAILED DESCRIPTION OF THE PREFERRED EMBODIMENTS

Figure 1:
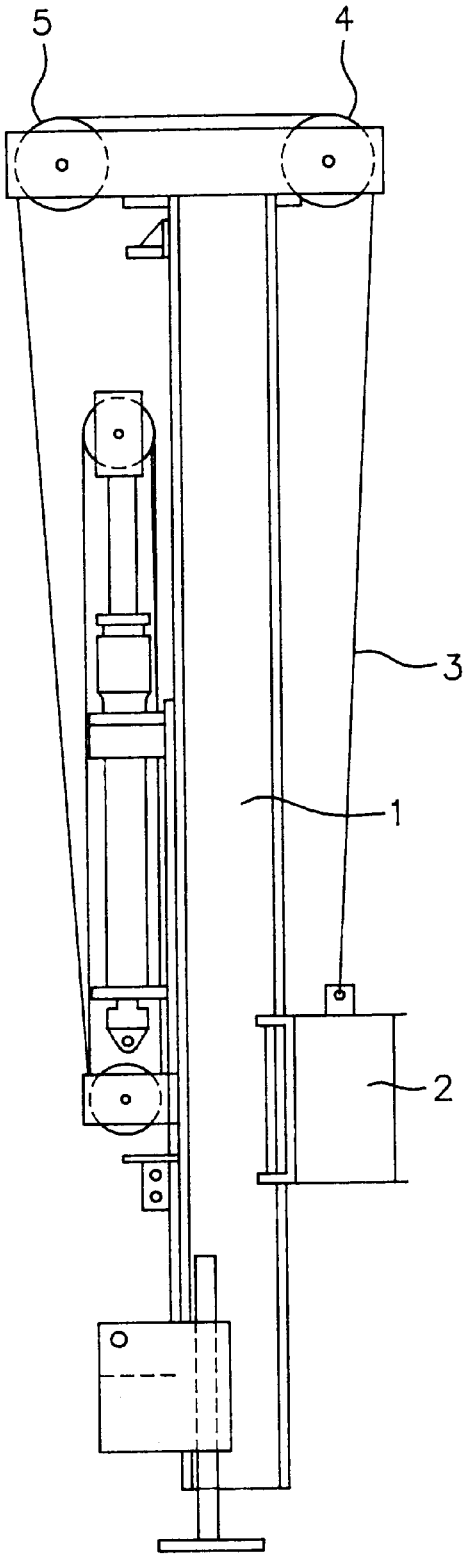
FIGS. 1 to 4 are the Figures referred to previously of New Zealand Patent Specification 174807.
Figure 2:
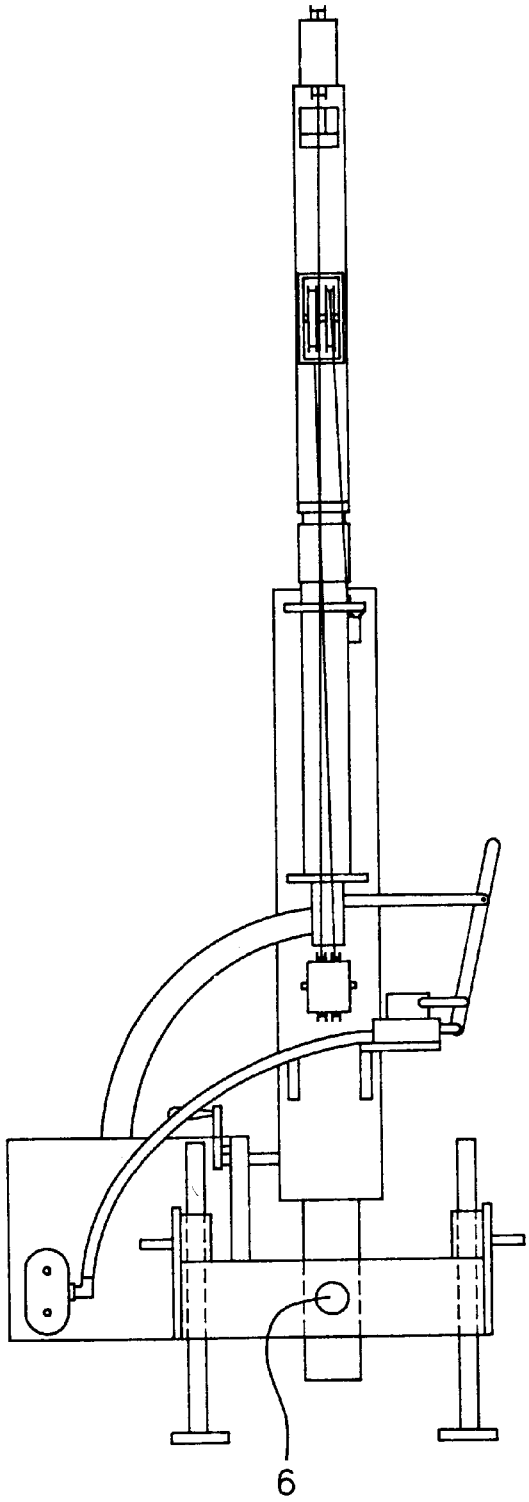
Figure 3:
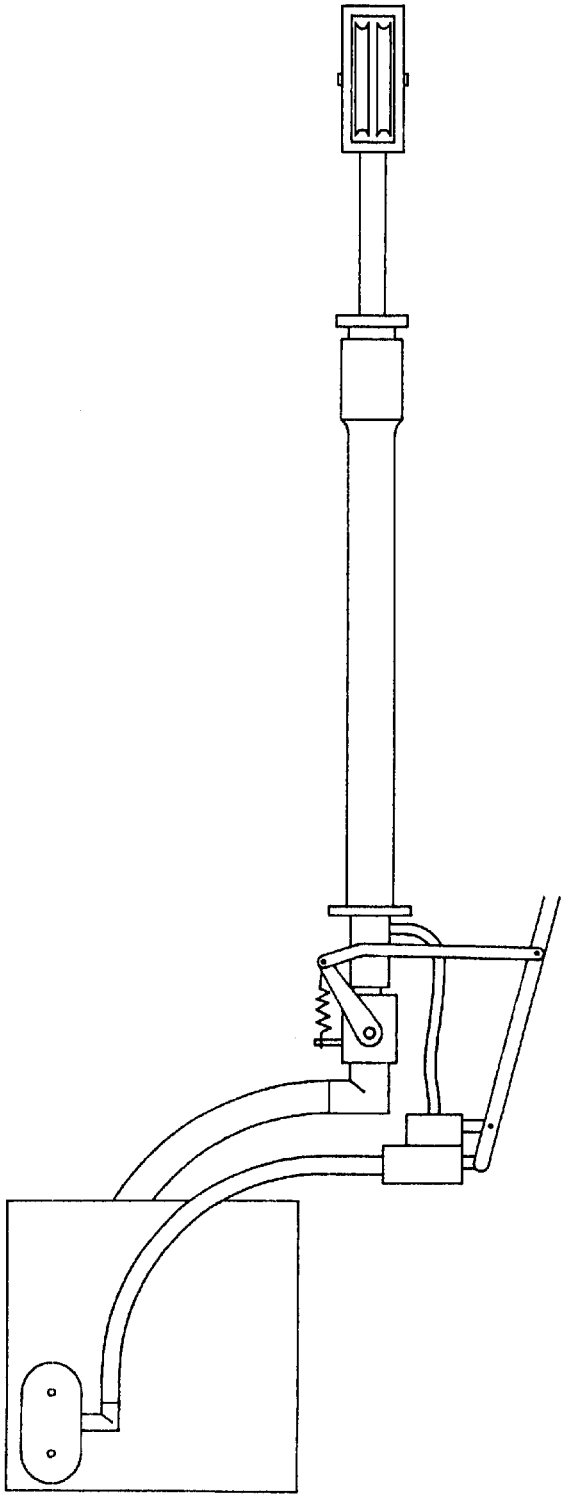
Figure 4:
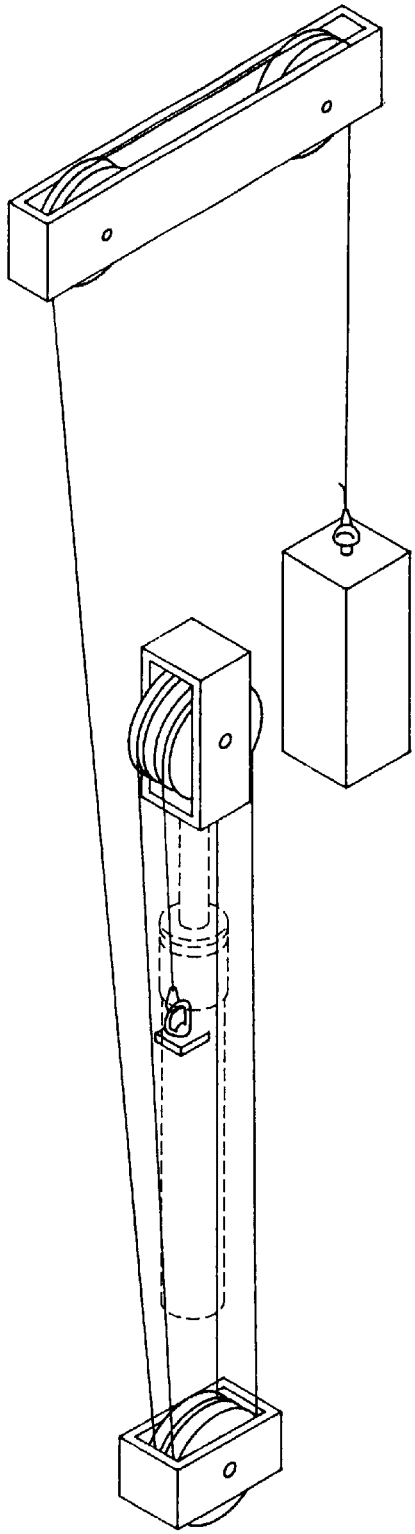

FIGS. 1 to 4 are FIGS. 1 to 4 from the aforementioned New Zealand Patent Specification 174807 which is disclosed herein by way of reference, there being shown a beam 1 on which the monkey 2 is slidably engaged to the flanges of the "I" beam section to be moved reproducibly vertically thereon under the action of the cable 3. The cable 3 passes over the pullies 4 and 5 supported by the fixed structure at the top end of the beam. The beam itself is mounted by a pivot axis 6 to appropriate mounting means, preferably directly carried by, for example, the three point linkage of a vehicle. The hydraulic system (of any suitable type) allows the uplifting of the monkey and then its dropping under gravity.

Such a beam of NZ 174807 is adapted for pivotal mounting using a stub axle.

Figure 5:
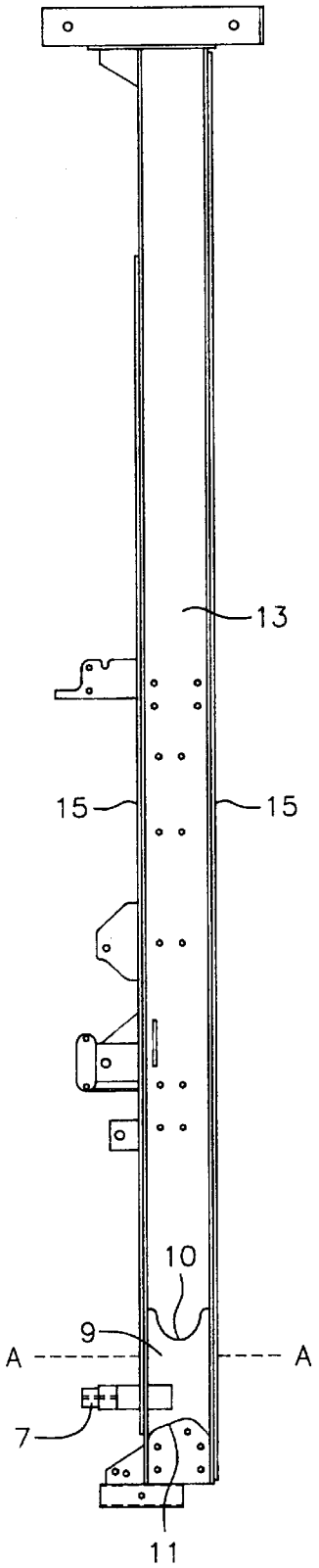
FIG. 5 is a side elevational view of a beam in accordance with the present invention in one of its embodiments, the lower region thereof being adapted for pivotal mounting reliant upon a stub axle which extends outwardly in a direction parallel to the plane of the web.
Figure 6:
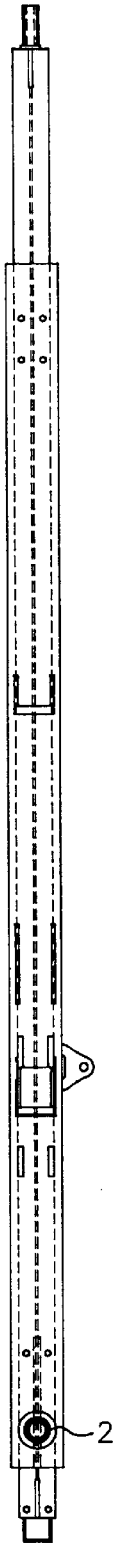
FIG. 6 is a side elevation view looking in the direction towards the stub axle.
Figure 7:
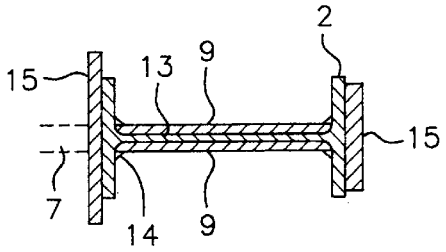
FIG. 7 is a section at AA of FIG. 5 showing the reinforcement at that zone at and or about the adaption for mounting of a spanning plate on either side of the web of the "I" beam and a longitudinal running plate or strip affixed to each of the outsides of each flange pair of the "I" beam.
Figure 8:
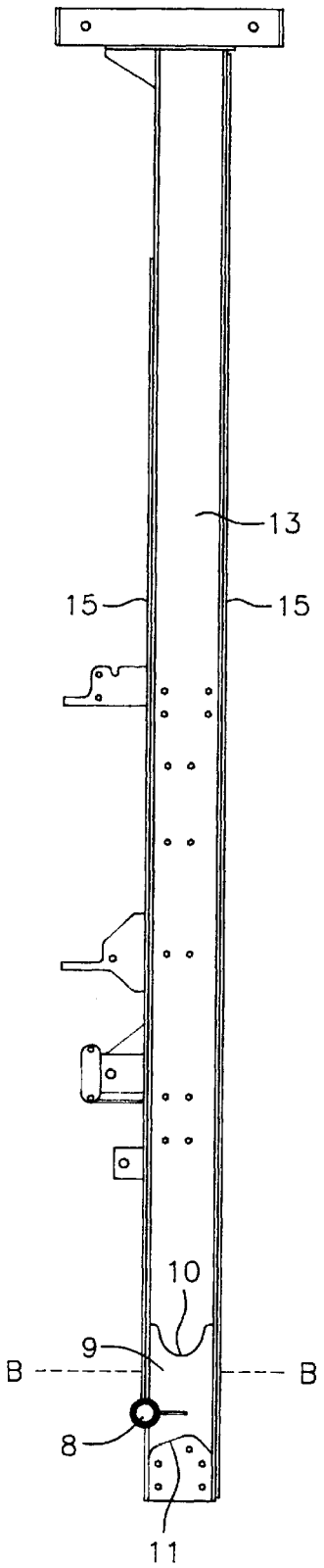
FIG. 8 shows an alternative embodiment from that of FIGS. 5 through 7 where the adaption fore mounting is reliant upon a pivot sleeve the axis of which is normal to the plane of the web of said "I" beam.
Figure 9:
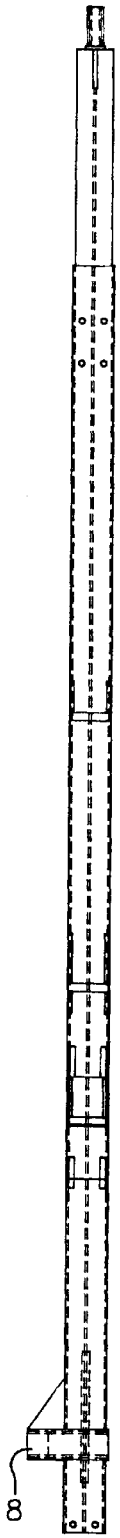
FIG. 9 is a similar side elevational view to that of FIG. 6 but this time of the embodiment of FIG. 8.
Figure 10:
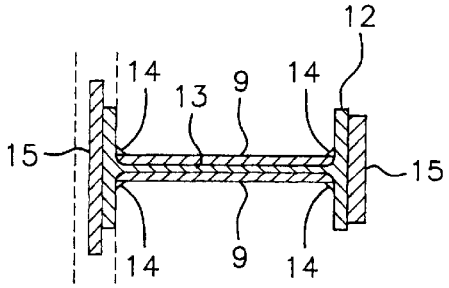
FIG. 10 is a section at BB of the reinforced zone at and/or about the adaption for mounting.

In the preferred form of the present invention the zone of most risk to rupture is that at and/or about the preferred pivot mounting of the device. In the embodiment of FIGS. 5 to 7 there can be seen the stub axle 7 (akin to that of NZ 174807) whilst in the embodiment of FIGS. 8 to 10 there can be seen a pivot sleeve 8.

The mounting zone at most risk is that reinforced by the spanning member or plate 9 which preferably has an upper scalloped edge 10 and an appropriate configured (almost reverse scalloped) lower edge region 11. The "I" beam 12 has the steel plates 9 attached to it without any substantial welding thereof to the "I" beam web.

I have found that any encroachment of a weld (eg; beyond the merest of a stitch weld) into the web the "I" beam section is detrimental to the long term performance of that zone. I have also determined that sufficiently reinforcement of that "at risk" zone at and/or about the pivot mounting can be provided by confining the welding of the spanning plate 9 to the zones 14 only.

Likewise I have determined it is sufficient if the longitudinally running strips 15 are welded to the respective flange pair by appropriate stitch welding.

I have determined that a method of reinforcement consisting no more than the addition of one or two spanning members 9 to an "I" beam with continuous welding at the longitudinal opposed edges only significantly enhances its longevity. There is also a prospect here of using stitch welding. Moreover I have determined a lighter "I" beam form can be utilised as a mast where the web is flanked on either side by a plate 9 welded into the flanges only and there is in addition longitudinally running stitch welded reinforcement strips 15.

Examples of the materials utilised are mild steels. For a beam of, for example, a length of from say 3.8 to say 5.5 metres can utilise a universal "I" beam of 180×22.2 mm section to be reinforced by a spanning plate 6 mm thick and longitudinal strips 10 and/or 12 mm thick (eg; FMS 130×10 mm and FMS 80×12).

What is claimed is:

1. A beam for a post driver, comprising: a steel "I" beam having a web and two flange pairs each separated from the other pair by a lateral width of the web, wherein a lower region of the "I" beam has been strengthened by provision on at least one side of the web of a web spanning member which is welded at each of opposed edges parallel to a longitudinal axis of the "I" beam into a flange of said "I" beam, said lower region of the "I" beam being at and adjacent an adaption thereof for connection to a mounting so that it is useable as a beam of a post driver, said adaption providing a pivot mounting, said adaption being an outstanding stub axle extending in a direction which includes a plane of said web.

2. Apparatus of claim 1 wherein said web spanning member is a plate.

3. Apparatus of claim 1 wherein said spanning member is attached by welding only at said opposed edges.

4. Apparatus as claimed in claim 3 wherein said welding is stitch welding.

5. Apparatus as claimed in claim 3 wherein a said spanning member is provided on each of the opposing sides of said web of the "I" beam.

6. Apparatus as claimed in claim 1 wherein at least one flange pair is strengthened by a longitudinally running reinforcement plate welded thereto on a side remote from said web.

7. Apparatus of claim 6 wherein both flange pairs is reinforced for much of their longitudinal length.

8. Apparatus as claimed in claim 7 wherein one such longitudinally running reinforcement plate is wider than the pair of flanges to which it is affixed whilst the other is not.

9. A post driver comprising: a steel "I" beam having a web and two flange pairs each separated from the other pair by a lateral width of the web, a lower region of the "I" beam having been strengthened by provision on at least one side of the web, one of and about a mounting zone, of a plate which is welded only at each of opposed edges parallel to a longitudinal axis of the "I" beam into a flange of said "I" beam, said lower region of the "I" beam being at and adjacent an adaption thereof for connection to a mounting so that it is useable as a beam of a post driver, said adaption providing a pivot mounting, said adaption being an outstanding stub axle extending in a direction which includes a plane of said web.

10. A post driver comprising: a pivotally mounted beam, said beam being of a fabricated construction at least essentially of a steel "I" beam having a web and two flange pairs separated by a lateral width of the web, a first longitudinally running strengthening strip welded to an outside of one of said flange pairs, and on at least one side of the web a spanning member between the flanges of the two pairs to reinforce a zone at which the beam is pivot mounted, said spanning member being welded only into each said flange.

11. Apparatus as claimed in claim 10 wherein there is similarly welded a similar spanning plate on each side of the web.

12. Apparatus of claim 10 wherein each said flange pair is reinforced by such a longitudinally running strip.

13. A beam for a post driver, comprising: a steel "I" beam having a web and two flange pairs each separated from the other pair by a lateral width of the web, wherein a lower region of the "I" beam has been strengthened by provision on at least one side of the web of a web spanning member which is welded at each of opposed edges parallel to a longitudinal axis of the "I" beam into a flange of said "I" beam, said lower region of the "I" beam being at and adjacent an adaption thereof for connection to a mounting so that it is useable as a beam of a post driver, said adaption providing a pivot mounting, said adaption being a pivot sleeve extending normal to a plane of said web.

14. A post driver comprising: a steel "I" beam having a web and two flange pairs each separated from the other pair by a lateral width of the web, a lower region of the "I" beam having been strengthened by provision on at least one side of the web, one of and about a mounting zone, of a plate which is welded only at each of opposed edges parallel to a longitudinal axis of the "I" beam into a flange of said "I" beam, said lower region of the "I" beam being at and adjacent an adaption thereof for connection to a mounting so that it is useable as a beam of a post driver, said adaption providing a pivot mounting, said adaption being a pivot sleeve extending normal to a plane of said web.

15. A post driver comprising: a pivotally mounted beam, said beam being of a fabricated construction at least essentially of a steel "I" beam having a web and two flange pairs separated by a lateral width of the web, a first longitudinally running strengthening strip welded to an outside of one of said flange pairs, a second longitudinally running strip welded to an outside surface of the other flange pair, and on at least one side of the web a spanning member between the flanges of the two pairs to reinforce a zone at which the beam is pivot mounted, said spanning member being welded only into each said flange.

16. Apparatus as claimed in claim 15, wherein there is similarly welded a similar spanning plate on each side of the web.

* * * * *